United States Patent [19]

Graham et al.

[11] Patent Number: 4,889,569

[45] Date of Patent: Dec. 26, 1989

[54] LITHIUM BEARING ALLOYS FREE OF LÜDER LINES

[75] Inventors: Wesley H. Graham, Renton; Sven E. Axter, Bellevue; Fu-Shiong Lin, Renton, all of Wash.

[73] Assignee: The Boeing Company, Seattle, Wash.

[21] Appl. No.: 173,091

[22] Filed: Mar. 24, 1988

[51] Int. Cl.[4] ..... C21D 1/78

[52] U.S. Cl. ..... 148/130; 148/11.5 A; 148/439

[58] Field of Search ..... 148/2, 11.5 A, 12.7 A, 148/130, 415–418, 437–440

[56] References Cited

U.S. PATENT DOCUMENTS

| | | | |
|---|---|---|---|
| 4,081,294 | 3/1978 | Thompson et al. | 148/439 |
| 4,151,013 | 4/1979 | Thompson et al. | 148/439 |
| 4,648,913 | 3/1987 | Hunt, Jr. et al. | 148/415 |
| 4,790,884 | 12/1988 | Young et al. | 148/2 |

*Primary Examiner*—Stephen J. Lechert, Jr.

*Attorney, Agent, or Firm*—Christensen, O'Connor, Johnson & Kindness

[57] ABSTRACT

Aluminum-lithium alloy sheets are stretched under predetermined temperature and stretch rate conditions to provide contoured metal sheets. The temperature and stretch rate conditions provide a stretched sheet which is substantially free of Lüder lines that are conventionally associated with stretch-formed aluminum-lithium alloy sheets.

20 Claims, 1 Drawing Sheet

LITHIUM BEARING ALLOYS FREE OF LÜDER LINES

BACKGROUND OF THE INVENTION

The invention relates to aluminum alloys containing lithium as an alloying element, and particularly to a process for stretching the aluminum-lithium alloys without producing strain-induced imperfections known as Lüder lines.

It has been estimated that some current large commercial transport aircraft may be able to save from 15 to 20 gallons of fuel per year for every pound of weight that can be saved when building the aircraft. Over the projected 20-year life of an airplane, this savings amounts to 300 to 400 gallons of fuel for every pound of weight saved. At current fuel costs, a significant investment to reduce the structural weight of the aircraft can be made to improve overall economic efficiency of the aircraft.

The need for improved performance in aircraft of various types can be satisfied by the use of improved engines, improved airframe design, or by the use of new or improved structural materials. Improvements in engines and aircraft design have been vigorously pursued, but only recently has the development of new and improved structural materials received commensurate attention, and their implementation in new aircraft designs is expected to yield significant gains in performance.

Materials have always played an important role in dictating aircraft structural concepts. Since the early 1930's, structural materials for large aircraft have remained remarkably consistent, with aluminum being the primary material of construction in the wing, body and empennage, and with steel being utilized for landing gears and certain other specialty applications requiring very high strength. Over the past several years, however, several important new material concepts have been under development for incorporation into aircraft structures. These include new metallic materials, metal matrix composites and resin matrix composites. It is believed by many that improved aluminum alloys and carbon fiber resin matrices will dominate aircraft structural materials in the coming decades. While composites will be used in increased percentages as aircraft structural materials, new lightweight aluminum alloys, and especially aluminum-lithium alloys show great promise for extending the usefulness of materials of this type.

Heretofore, aluminum-lithium alloy products of the types described hereinafter have not been used in aircraft structure. Aircraft applications for alloys of the type have heretofore been restricted to uses wherein the mill product has been adapted by machining or otherwise contouring the product form without the need for stretching. The state-of-the-art in producing suitably strong, yet damage-tolerant aluminum lithium alloy sheets, has progressed to a point that its inherent properties are attractive for air transport body skins. Body-skin applications, however, have been restricted because of the alloys' propensity to form Lüder-lines at low relative amounts of contour stretching. These Lüder lines are aesthetically objectionable, and may compromise engineering properties.

It is generally understood that Lüder line phenomena are associated with non-homogeneous deformation of the metal alloy. Although other aluminum-based alloy materials exist that only occasionally suffer from the formation of Lüder lines, lithium additions to aluminum provide a substantial density reduction which has been determined to be very important in decreasing the overall structural weight of the aircraft. While substantial strides have been made in improving the aluminum-lithium processing technology, a major challenge remains to obtain a stretch-formed sheet of these aluminum-lithium alloys whose surfaces are substantially free of Lüder lines.

SUMMARY OF THE INVENTION

The present invention provides sheets of aluminum-lithium alloys which are substantially free of Lüder lines, that also have suitably high tensile strengths yet retain high damage tolerance. The sheets of aluminum-lithium alloy are formed by stretching the sheets under specific combinations of temperature and stretch rate conditions that prevent the formation of Lüder lines. Generally, the sheets can be stretched at least 3% of their original dimensions without forming Lüder lines by choosing a temperature ranging from about −50° to about 350° F. and a stretch rate ranging from about 0.1%/minute to about 50%/minute.

The stretching process provides sheets of aluminum-lithium alloy which are substantially free of Lüder lines, a condition that is not achieved when aluminum-lithium alloy sheets are stretched by conventional means. These sheets will have engineering properties, including tensile strength and damage tolerance, that will allow them to be used as contoured body skin structures for aircraft. Success of the process depends on controlling the stretching parameters (i.e., temperature and stretch-rate) both of which can be simply and accurately monitored, thus resulting in a Lüder line-free product with consistent properties.

BRIEF DESCRIPTION OF THE DRAWING

A better understanding of the present invention can be derived by reading the ensuing specification in conjunction with the accompanying drawing wherein.

DETAILED DESCRIPTION OF THE INVENTION

Figure 1:
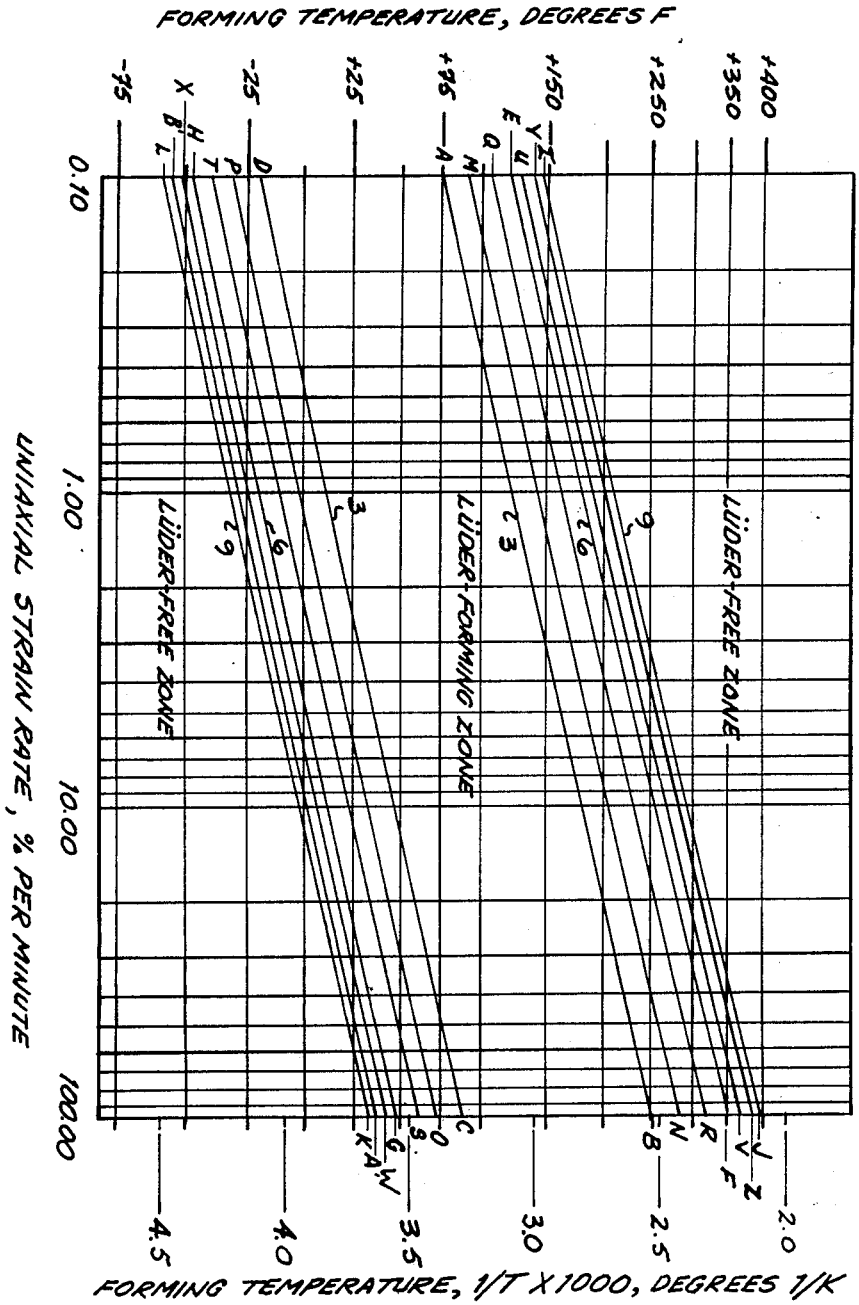
FIG. 1 is a graph showing the percent stretch at the onset of Lüder line formation as a function of the temperature and stretch rate conditions for alloys in the T6 temper, as described in the example.

An aluminum-lithium alloy formulated in accordance with the present invention can contain from about 1.7 to about 2.3 percent lithium. The current data indicates that the benefits of the stretching process in accordance herewith are most apparent at lithium levels of between 1.7 to about 2.3 percent, however other alloys containing more or less lithium may benefit equally as much from the present invention. All percentages herein are by weight percent (wt %) based on the total weight of the alloy unless otherwise indicated. Additional alloying agents such as magnesium and copper can also be included in the alloy. Alloying additions function to improve the general engineering properties but also affect density somewhat. Zirconium is also present in these alloys for grain size control at levels between 0.04 to 0.16 percent. Zirconium is essential to the development of the desired combination of engineering properties in aluminum-lithium alloys, including those subjected to our stretching process.

The impurity elements iron and silicon can be present in amounts up to 0.30 and 0.20 percent, respectively. It is preferred, however, that these elements be present only in trace amounts of less than 0.12 and 0.10 percent, respectively. Certain trace elements such as zinc and titanium may be present in amounts up to but not to exceed 0.25 percent and 0.10 percent, respectively. Certain other trace elements such as manganese and chromium must each be held to levels of 0.10 percent or less. If these maximums are exceeded, the desired properties of the aluminum-lithium alloy will tend to deteriorate. The trace elements potassium and sodium are also thought to be harmful to the properties of aluminum-lithium alloys and should be held to the lowest levels practically attainable, for example, on the order of 0.003 percent maximum for potassium and 0.0015 percent maximum for sodium. The balance of the alloy, of course, comprises aluminum.

The following table represents the preferred proportions in which the alloying and trace elements may be present to provide the best set of overall properties for use in aircraft structures. The broadest ranges are acceptable under some circumstances. The present invention will be equally applicable to other aluminum-lithium alloys that suffer from the formation of Lüder lines, though not within the preferred ranges disclosed below.

TABLE

| Element | Amount (wt %) Acceptable | Preferred |
|---|---|---|
| Li | 1.7–2.8 | 1.7 to 2.3 |
| Mg | 2.0 max | 1.1 to 1.9 |
| Cu | 1.0–3.0 | 1.8 to 2.5 |
| Zr | 0.04–0.16 | 0.06 to 0.16 |
| Mn | 0.10 max | 0.10 max |
| Fe | 0.30 max | 0.12 max |
| Si | 0.20 max | 0.10 max |
| Zn | 0.25 max | 0.25 max |
| Ti | 0.15 max | 0.10 max |
| Cr | 0.10 max | 0.10 max |
| K | 0.05 max | 0.0030 max |
| Na | 0.05 max | 0.0015 max |
| Other trace elements | | |
| each | 0.05 max | 0.05 max |
| total | 0.15 max | 0.015 max |
| Al | Balance | Balance |

An aluminum-lithium alloy formulated in the proportions set forth in the foregoing paragraphs and table is processed into an article utilizing known techniques. The alloy is formulated in molten form and cast into an ingot. The ingot is then homogenized at temperatures ranging from 980° F. to approximately 1010° F. Thereafter, the alloy is converted into a usable article by conventional mechanical forming techniques such as rolling, extrusion or the like. Once an article is formed, the alloy is normally subjected to a solution treatment at temperatures ranging from 980° to 1010° F., followed by quenching into a medium such as water that is maintained at a temperature on the order of 40° F. to 90° F. Alloys of this type are commercially available from Pechiney Aluminum or the Aluminum Company of America (Alcoa) under the designation 2091. Each alloy is produced in various tempers by varying the particular conditions such as solution treatment, quench, stretch and aging under which the alloy is produced. Examples of suitable tempers include T4, T6, and T8 that are in accordance with the guidelines and definitions of ANSI H35.1 as published by the Aluminum Association.

Thereafter, in accordance with the present invention, a sheet of the aluminum-lithium alloy is stretched at least about 3% up to about 9% of its original dimensions to contour it into various shapes, such as aircraft structures, without the formation of Lüder lines. The percent of the original dimensions that the sheets are stretched is measured in the direction of the applied stretching force. In order to provide these stretched sheets in a condition substantially free of Lüder lines, the sheet is stretched under a combination of temperature and stretch rate conditions that range from about −50° F. to about 350° F. and 0.1%/minute to about 50%/minute, respectively, depending on the total amount of stretch desired. In the aircraft industry, where 6 to 7 percent stretching of the aluminum-lithium alloy sheet is often desired, the options for stretching at low temperatures (−30° F. to +40° F.) and high strain rates (1% per min. to 10% per min.), or, at higher tempertures (140° F. to 200° F.) and low strain rates (0.1% per min. to 5% per min.) need to be balanced economically based on available facilities and the production rates required. For example, when body-skin contouring requires 6% longitudinal stretch in the T6 temper without Lüder line formation, the sheet may be stretched at about 30° F. using a strain rate of about 10% per minute. Alternatively, the same degree of longitudinal stretch could be accomplished by forming at about 180° F. using a strain rate of about 1% per minute. Other stretch conditions will provide substantially the same result but will not be as economical.

When the stretching of the aluminum-lithium alloy sheet in the T6 temper is conducted in accordance with the parameters set forth above as represented graphically in FIG. 1, the process will result in a stretched aluminum-lithium alloy sheet which is substantially free of Lüder lines. Similar graphs can be constructed for the T4 and T8 tempers of the aluminum-lithium alloy. Analogous "safe" zones exist for the F, O, W, T3, or T7 tempers, but require secondary heat treatment and/or greater extremes in temperature and strain rate during forming.

The following Example is presented to illustrate the Lüder line free sheet achieved by the stretching process of an aluminum-lithium alloy in accordance with the present invention and to assist one of ordinary skill in making and using the present invention. The following Example is not intended in any way to otherwise limit the scope of this disclosure or the protection granted by Letters Patent hereon.

EXAMPLE

An aluminum alloy containing 2.0 percent lithium, 1.5 percent magnesium, 2.2 percent copper, 0.12 percent zirconium with the balance being aluminum is formulated. The trace elements present in the formulation constituted less than 0.15 percent of the total. The alloy is cast and homogenized at 1000° F. Thereafter, the alloy is hot rolled to a thickness of 0.063 inches. The resulting sheet is then solution treated at 990° F. for about 0.5 hour. The sheet is then quenched in water and maintained at about 75° F. and aged at 275° F. for 12 hours. A similar aluminum-lithium alloy is commercially available from Pechiney Aluminum or Alcoa under the designation 2091 with a T6 temper.

The specimens having original dimension of 3 inches by 10 inches are then stretched with a tensile machine under a plurality of combined temperature (°F) and stretch rate (%/minute) conditions, ranging from 350° F. to −50° F. and 0.1%/minute to 50%/minute. The percent stretch (i.e., % increase in the original dimension of the sheet in the direction of the stretch) attained for a given temperature and stretch rate at the onset of Lüder lines appearing in the sheet anyway between the grips of the tensile machine is determined using visual observation of the specimen surface and load-deflection recordings. The summary of the percent stretch attained is graphically illustrated in FIG. 1 as a function of the temperature and the stretch rate. This example illustrates that Lüder-free stretching is not possible with conventional methods at room temperature. The T6 temper is the least prone toward Lüder formation using conventional stretch-processing, and lends itself to the least amount of stretch rate and temperature control process modification.

As illustrated in FIG. 1 by the "LÜDER-FREE ZONE" regions, the specimens stretched at least 3%, as represented by lines 3, under a combination of temperature and stretch rate conditions that fall outside the polygon ABCDA do not exhibit Lüder line formation. Likewise, those specimens stretched at least 6%, as represented by lines 6, under a combination of temperature and stretch rate conditions that fall outside the polygon EFGHE do not exhibit Lüder lines. Finally, specimens that are stretched at least 9%, as represented by lines 9, under temperature and stretch rate conditions outside the polygon IJKLI do not exhibit Lüder line formation. Similar polygons are defined for other percent stretch values and are summarized in Table I below.

TABLE I

| Percent Stretch at Onset of Luder Lines | Polygon |
|---|---|
| 4 | MNOPM |
| 5 | QRSTQ |
| 7 | UVWXU |
| 8 | YZA'B'Y |

Some of the stretched (6%) specimens which were free of Lüder lines are then tested for total yield strength, ultimate tensile strength, % elongation and Young's Modulus, by known methods. The recorded values are summarized in Table II.

TABLE II

| | |
|---|---|
| Total yield strength (psi) | 58,000–63,000 |
| Ultimate tensile strength (psi) | 65,000–75,000 |
| % Elongation (%) | ≧13 |
| Young's Modulus ($10^6$ psi) | 11–11.4 |

The present invention has been described in relation to various embodiments, including the preferred processing parameters and formulations. One of ordinary skill after reading the foregoing specification will be able to effect various changes, substitutions of equivalents and other alterations without departing from the broad concepts disclosed herein. For example, it is contemplated that the subject stretching process treatment may be applicable to other alloying combinations not now under development, and specifically to aluminum-lithium alloys with substantial amounts of zinc, silicon, iron, nickel, beryllium, bismuth, germanium, and/or zirconium. It is therefore intended that the scope of Letters Patent granted hereon will be limited only by the definition contained in the appended claims and equivalents thereof.

The embodiments of the invention in which an exclusive property or privilege is claimed are defined as follows:

1. A metal sheet comprising: a sheet of an aluminum-lithium alloy consisting essentially of:
(a) about 1.7 to about 2.8% by weight lithium;
(b) about 1.0 to about 3.0% by weight copper;
(c) about 0.0 to about 2.0% by weight magnesium;
(d) about 0.04 to about 0.16% by weight zirconium; and
(e) aluminum; the sheet intentionally stretched at least 3% of its original dimensions in the direction of the stretch under a predetermined combination of temperature and stretch rate conditions that provides the stretched sheet substantially free of Lüder lines.

2. The metal sheet of claim 1, wherein the sheet is intentionally stretched at least 6% of its original dimensions in the direction of the stretch under a predetermined combination of temperature and stretch rate conditions that provides the stretched sheet substantially free of Lüder lines.

3. The metal sheet of claim 1, wherein the aluminum-lithium alloy consists of:
(a) about 1.7 to about 2.3% by weight lithium;
(b) about 1.8 to about 2.5% by weight copper;
(c) about 1.1 to about 1.9% by weight magnesium;
(d) about 0.06 to about 0.16% by weight zirconium;
(e) about 0 to about 0.12% by weight iron;
(f) about 0 to about 0.10% by weight silicon;
(g) about 0 to about 0.10% by weight chromium;
(h) about 0 to about 0.10% by weight manganese;
(i) about 0 to about 0.25% by weight zinc;
(j) about 0 to about 0.10% by weight titanium; and
(k) aluminum.

4. The metal sheet of claim 3, including about 0 to about 0.15% by weight trace impurities, with the maximum amount of any one trace impurity being about 0.05% by weight.

5. The metal sheet of claim 3 wherein the metal sheet has a temper selected from the group consisting of T4, T6 and T8 tempers.

6. A method for stretching an aluminum-lithium alloy sheet comprising the step of intentionally stretching the aluminum-lithium alloy sheet at least about 3% of its original dimensions in the direction of the stretch under a predetermined combination of temperature and stretch rate conditions that is outside the region defined by the polygon ABCDA in FIG. 1, such that the stretched sheet is substantially free of Lüder lines, the aluminum-lithium alloy sheet consisting essentially of about 1.7 to about 2.8% by weight lithium, about 1.0 to about 3.0% by weight copper, about 0.0 to about 2.0% by weight magnesium, about 0.04 to about 0.16% by weight zirconium, and aluminum.

7. The method of claim 6, wherein the aluminum-lithium alloy sheet is stretched at least about 6% of its original dimensions in the direction of the stretch under a combination of temperature and stretch rate conditions that is outside the region defined by the polygon EFGHE in FIG. 1.

8. The method of claim 7, wherein the aluminum-lithium alloy sheet is stretched at least about 9% of its original dimensions in the direction of the stretch under a combination of temperature and stretch rate conditions that is outside the region defined by the polygon IJKLI in FIG. 1.

9. The method of claim 6, wherein the aluminum-lithium alloy sheet has a temper selected from the group consisting of T4, T6 and T8 tempers.

10. The aluminum-lithium alloy sheet prepared in accordance with the method of claim 6.

11. The aluminum-lithium alloy sheet prepared in accordance with the method of claim 7.

12. A metal sheet comprising:

a stretched sheet of an aluminum-lithium alloy consisting essentially of:

(a) about 1.7 to about 2.3% by weight lithium;

(b) about 1.8 to about 2.5% by weight copper;

(c) about 1.1 to about 1.9% by weight magnesium;

(d) about 0.06 to about 0.16% by weight zirconium; and (e) aluminum, the stretched sheet having a total yield strength of at least about 51,000 psi, the stretched sheet being substantially free of Lüder lines.

13. The metal sheet of claim 12, having an ultimate tensile strength of at least 65,000 psi.

14. A metal aircraft body skin prepared in accordance with the method of claim 6.

15. A metal aircraft body skin prepared in accordance with the method of claim 7.

16. The metal sheet of claim 1, wherein the sheet is in the form of a body skin for an aircraft.

17. The metal sheet of claim 12, wherein the sheet is in the form of a body skin for an aircraft.

18. The metal sheet of claim 1, wherein the sheet is intentionally stretched at least 3% of its original dimensions in the direction of the stretch under a predetermined combination of temperature and stretch rate conditions that is outside the polygon ABCDA in FIG. 1, the stretched sheet being substantially free of Lüder lines.

19. The metal sheet of claim 2, wherein the sheet is intentionally stretched at least 6% of its original dimensions in the direction of the stretch under a predetermined combination of temperature and stretch rate conditions that is outside the polygon EFGHE in FIG. 1, the stretched sheet being substantially free of Lüder lines.

20. A method for stretching an aluminum-lithium alloy sheet comprising the step of intentionally stretching the aluminum-lithium alloy sheet at least about 3% of its original dimensions in the direction of the stretch under a predetermined combination of temperature and stretch rate conditions that provides the stretched sheet substantially free of Lüder lines, the aluminum-lithium alloy sheet consisting essentially of about 1.7 to about 2.8% by weight lithium, about 1.0 to about 3.0% by weight copper, about 0.0 to about 2.0% by weight magnesium, about 0.04 to about 0.16% by weight zirconium, and aluminum.

* * * * *

UNITED STATES PATENT AND TRADEMARK OFFICE

CERTIFICATE OF CORRECTION

PATENT NO. : 4,889,569

DATED : December 26, 1989

INVENTOR(S) : Graham et al.

It is certified that error appears in the above-identified patent and that said Letters Patent is hereby corrected as shown below:

| Column | Line | |
|---|---|---|
| 2 | 21 | "-50°" should be -- -50 -- |
| 4 | 20 | "tempertures" should be --temperatures-- |
| 6 | 6 | After the word "comprising:" begin a new paragraph with "a sheet. . ." |
| 6 | 13 | After "aluminum;" begin a new paragraph with "the sheet. . ." |

Signed and Sealed this

Second Day of April, 1991

*Attest:*

HARRY F. MANBECK, JR.

*Attesting Officer*

*Commissioner of Patents and Trademarks*